US005890499A

United States Patent [19]

Fuentes et al.

[11] Patent Number: 5,890,499

[45] Date of Patent: Apr. 6, 1999

[54] ERGONOMIC MASCARA SHIELD

[76] Inventors: Olga Fuentes; Rene Fuentes, both of 2500 Rivard St., Windsor, Ontario, Canada, N85 2H3

[21] Appl. No.: 40,695

[22] Filed: Mar. 18, 1998

[51] Int. Cl.[6] ..... A45D 29/00; A45D 40/30; A45D 40/26; A45D 40/24

[52] U.S. Cl. ..... 132/319; 132/216; 132/285; 132/320; 132/318

[58] Field of Search ..... 132/319, 285, 132/320, 317, 216, 318

[56] References Cited

U.S. PATENT DOCUMENTS

| | | | |
|---|---|---|---|
| 316,312 | 4/1885 | Cordova | D28/7 |
| 337,854 | 7/1886 | McCants | D28/7 |
| 341,001 | 11/1886 | Pantages | D28/7 |
| 377,405 | 1/1888 | Morell | D29/108 |
| 1,907,476 | 5/1933 | Ballard et al. | 132/319 |
| 1,974,825 | 9/1934 | Lovie | 132/216 |
| 2,260,614 | 10/1941 | Freitas | 132/216 |
| 3,789,856 | 2/1974 | Bomba | 132/319 |
| 5,016,658 | 5/1991 | Green | 132/216 |
| 5,050,624 | 9/1991 | Kobe et al. | 132/319 |
| 5,178,170 | 1/1993 | Kassai | 132/319 |
| 5,285,799 | 2/1994 | Minard | 132/319 |
| 5,311,888 | 5/1994 | Leigh | 132/319 |
| 5,503,109 | 4/1996 | Sporn | 132/150 |

*Primary Examiner*—Gene Mancene
*Assistant Examiner*—Trang Docin
*Attorney, Agent, or Firm*—Gifford, Krass, Groh, Sprinkle, Anderson & Citkowski, P.C.

[57] ABSTRACT

The present invention is an ergonomic mascara shield specifically designed to provide a barrier or protective shield over the upper and lower eyelid areas of a user's face to prevent smearing during the application of mascara. The device is comprised of an ergonomically designed eye portion being both angled and concave relative to an ergonomic handle portion integrally attached to the eye portion. The eye portion is adapted to fit even the deepest set eyes through its curvature and relative angle to the handle. The handle is designed to curve around the cheekbone and brow ridge thereby allowing the eye portion to rest comfortably and perfectly where desired in the eye socket. The handle likewise provides a contoured surface area to facilitate griping and positioning of the mascara shield in a preferred position against the lower or upper eyelids.

5 Claims, 3 Drawing Sheets

ERGONOMIC MASCARA SHIELD

BACKGROUND OF THE INVENTION

Mascara is typically applied to eyelashes last, after eye shadow and liner, by the wearer or a beauty assistant. A steady hand is required during its application so as not to smudge or smear previously applied cosmetics. The person using the mascara brush must exert sufficient pressure to apply the mascara to the lashes but not so much as to press the lashes against the skin where smudging will occur. However, this is a common problem for many people due to such factors as inexperience, shakiness of hands (commonly brought on by old age or disability) and/or pronounced facial features that make application difficult—such as deep set eyes.

FIELD OF THE INVENTION

This invention relates to an improved ergonomic mascara shield for use in the application of eye makeup, specifically mascara. It is specifically suitable for the application on both upper and lower eyelashes of each eye.

DESCRIPTION OF THE PRIOR ART

Numerous devices are known in the art for use as shields when applying mascara but all have major problems or limitations. These include: sharp edges directed inwardly toward the eyeball, shields with eye portions that are not angled or contoured to ergonomically accommodate the natural curvature of the eyeball or common facial structures such as deep set eyes, devices that must be flipped to work on the opposite eye thereby smudging mascara from the shield onto a clean eyelid, devices where the eye portion doubles as the handle when working on the opposite eyelid thereby messing fingers and providing poor handling. Other such devices include features such as handles too small to provide a proper gripping area making them clumsy and dangerous and shields designed only for use on lower lids.

Examples of prior art disclosures exhibiting the above features include U.S. Pat. No. 5,178,170, issued to Kassai which teaches an eyelash shield exhibiting concave curved edges at opposite ends of a generally elongate member. The curved ends are capable of being applied both above and below the eyes and between the face and eyelashes of the user to protect against smudging of mascara.

U.S. Pat. No. 5,311,888, issued to Leigh, teaches an ergonomic make-up shield exhibiting a curved smooth edge eye portion and an integrally attached handle portion. U.S. Pat. No. 5,016,658, issued to Green, teaches a makeup shield for both left and right eyelashes in which each end is configured with a radial arc which conforms generally to the slanted curvature of the left and right human eyes and facial bone structures. Finally, U.S. Pat. No. 5,050,624, issued to Kobe, discloses a disposable eye makeup shield including a flexible/rigid interior body and including an outer convex and arcuate side and an inner concave side. A lower portion is provided for grasping of the shield.

SUMMARY OF THE INVENTION

The present invention overcomes difficulties of prior art described above by disclosing a tool ergonomically designed to work with the natural shape of the face, accounting for the undulation of the eyeball and other important facial features like the cheekbone and brow ridge. The device is angled and curved in three different ways to provide a perfect and comfortable fit as well as making it suitable for use on upper and lower eyelids.

The eye portion features rounded edges that taper into flat "wings". These wings provide a safe and comfortable area to engage against the eyelid or corners. They also allow additional pressure to be exerted on the eyelid, if desired, to prevent blinking during the application of mascara or eyeliner, something not claimed by any prior shield device.

The device also features a handle, ergonomically designed to accommodate a variety of gripping methods determined by the individual's needs and/or preference. This handle provides 1.8 square inches of contoured gripping space—more than double that of any prior art device. The handle has also been angled and curved to account for natural facial features like the cheekbones and brow ridges to ensure that the eye portion rests comfortably and perfectly against the eyelid without sacrificing utility or comfort.

BRIEF DESCRIPTION OF THE DRAWINGS

Reference is now made to the attached drawings, when read in combination with the following detailed description, wherein like reference numerals refer to like parts throughout the several views, and in which.

DETAILED DESCRIPTION OF THE PREFERRED EMBODIMENT

Figure 1:
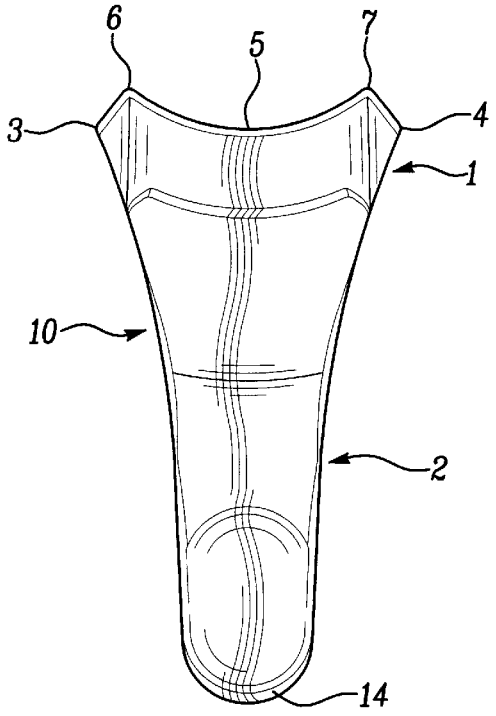
FIG. 1 is a front plan of the outer convex side of the mascara shield according to the present invention.
Figure 2:
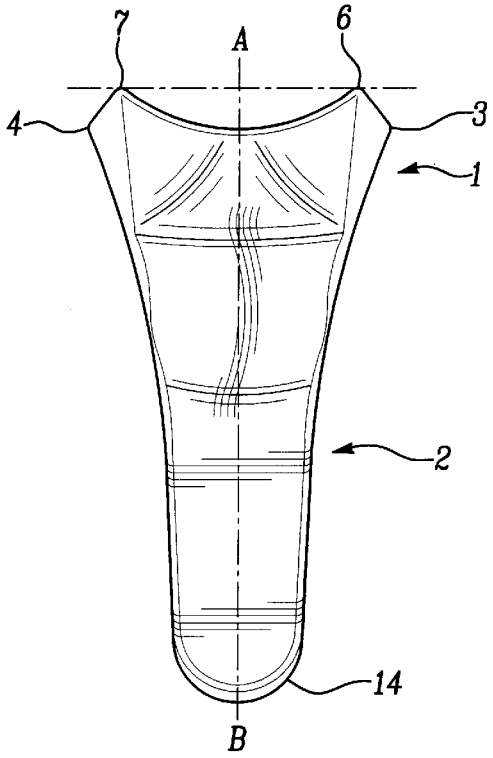
FIG. 2 is a rear plan view of the inner concave side of the mascara shield.

Referring to FIG. 1, an ergonomic mascara shield is illustrated at 10 according to the present invention for use in the application of mascara. The device according to the present invention is preferably formed from a unitary body of a durable and impact-resistant plastic material, such polymer materials typically being easier to mold or otherwise configure in the manner desired by the present invention. It is however further understood that the shield 10 may also be constructed of a lightweight metal, wood or other suitable material which incorporates the necessary contours as described herein.

As is best illustrated in the front plan view of FIG. 1, the shield 10 is constructed of an eye portion 1 and a handle portion 2 which are integrally connected. According to a preferred embodiment, the shield 10 measures 92 mm in overall length and 43 mm at its widest point between outermost edges 3 and 4 of the eye portion 1. It is however understood that the shield 10 can be provided according to any other set of dimensions without departing from its inventive scope.

Figure 3:
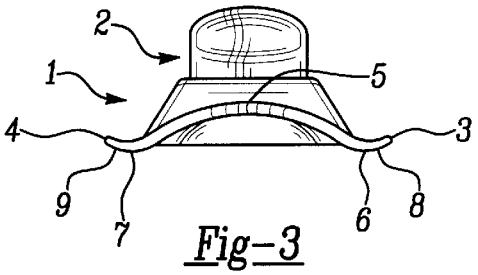
FIG. 3 is a top view of the mascara shield.
Figure 4:
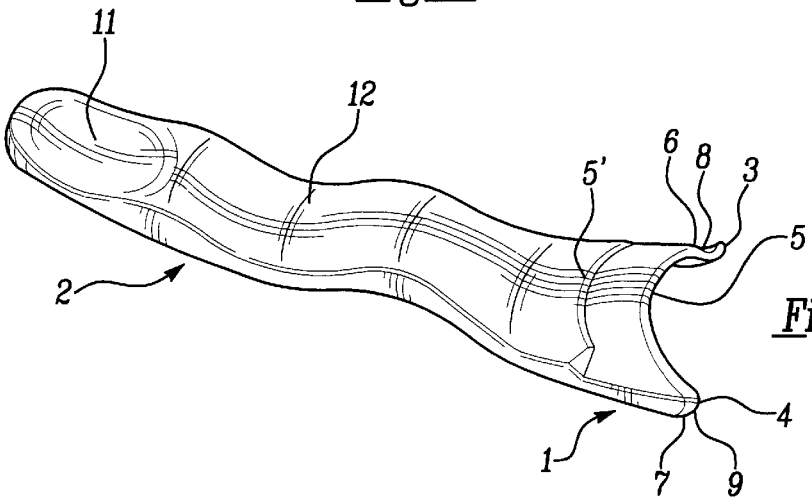
FIG. 4 is a perspective view of the mascara shield.
Figure 5:
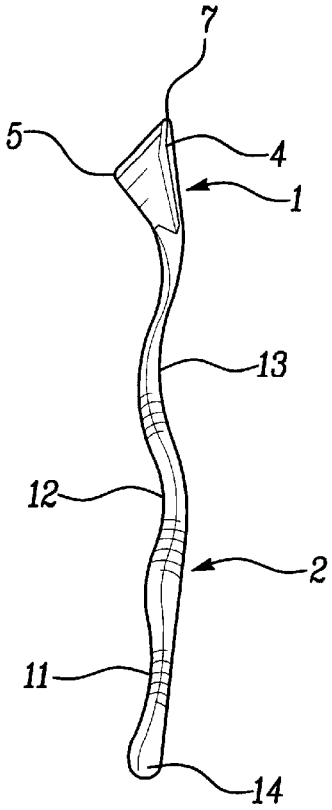
FIG. 5 is a side view of the mascara shield.
Figure 6:
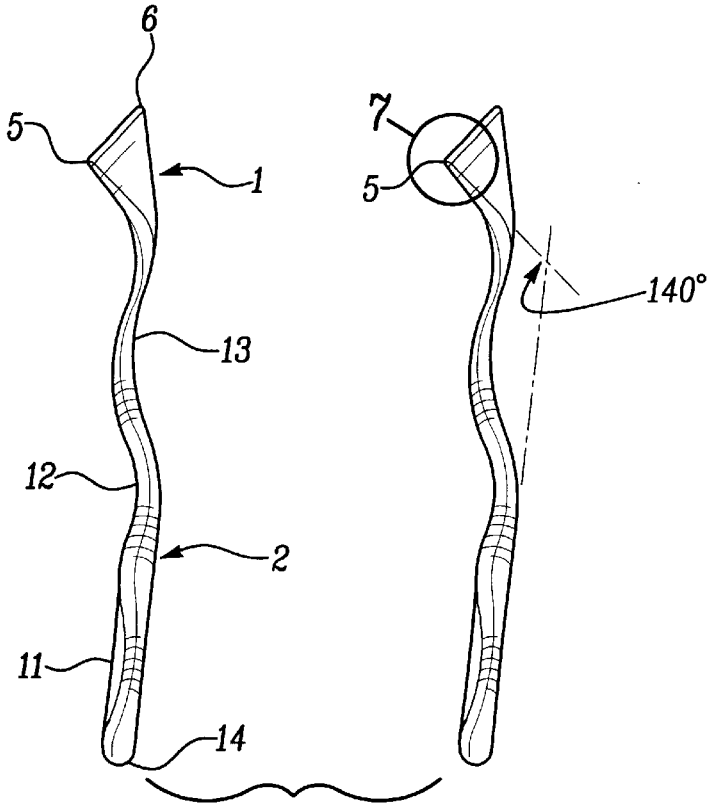
FIG. 6 is a vertical cut view of the mascara shield following the A-B line illustrated in FIG. 2.
Figure 7:
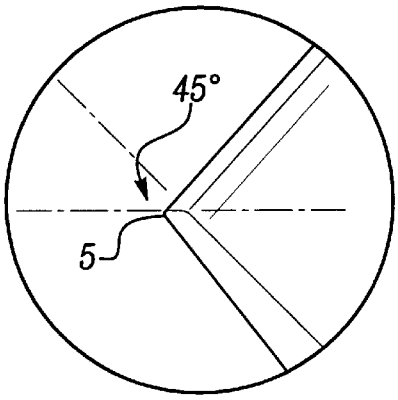
FIG. 7 is an enlarged view of the curved edge illustrated in FIG. 6.
Figure 8:
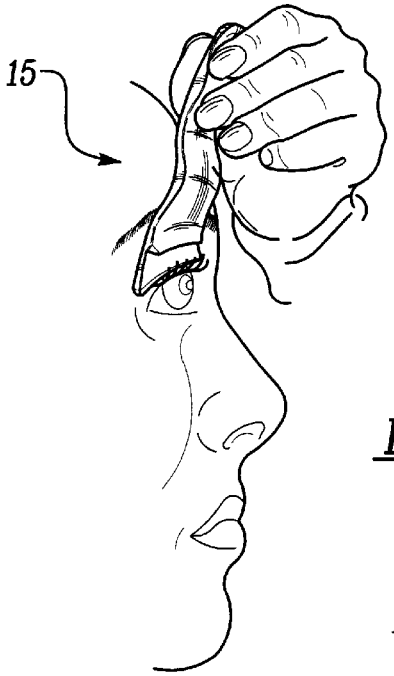
FIG. 8 is a side view illustrating the use of the mascara shield on the upper right eyelid.
Figure 9:
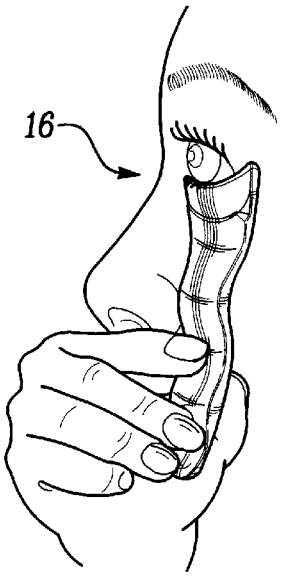
FIG. 9 is a side view illustrating the use of the mascara shield on the lower left eyelid.
Figure 10:
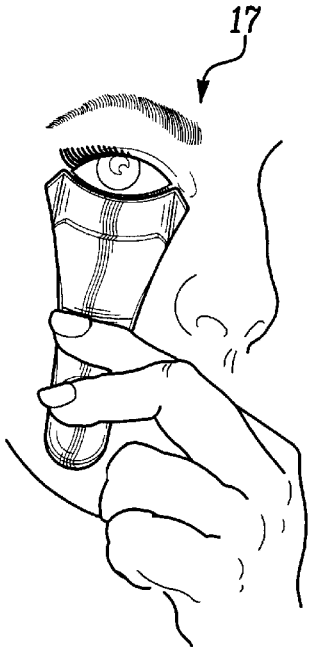
FIG. 10 is a front view illustrating the use of the mascara shield on the lower right eyelid.
Figure 11:
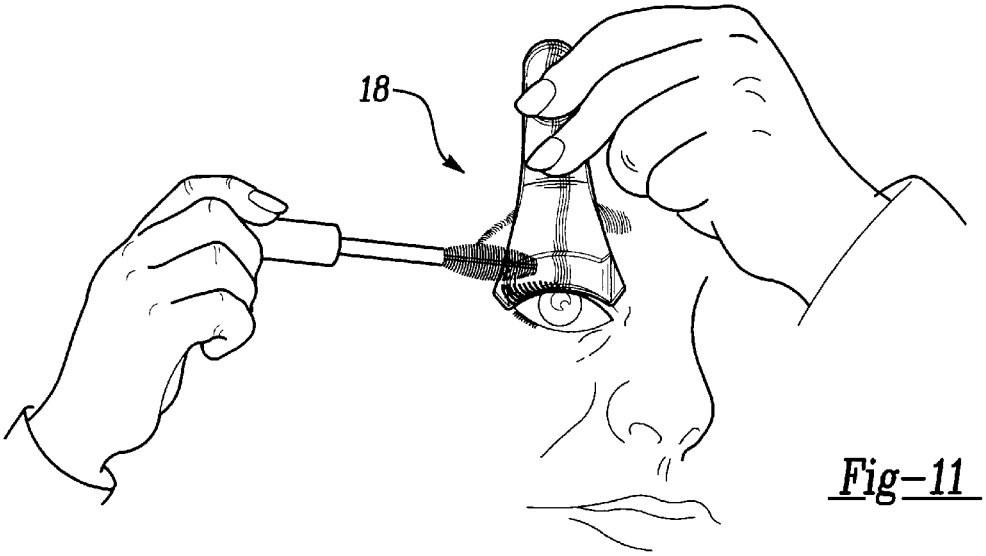
FIG. 11 is a front view illustrating the use of the mascara shield on the upper right eyelid.

The eye portion 1 is further defined by a curved arc 5 which extends between intermediate rounded corners 6 and 7 of the eye portion. In a preferred embodiment, the arc 5 measures 30 mm in length with a maximum curvature of 5 mm from a midpoint of the arc 5 to an intersecting line extending through the rounded corners 6 and 7 (see top view of FIG. 3). As is again best illustrated in FIG. 3, the curved arc includes rounded wing portions 8 and 9 (each typically measuring 5 mm in width) extending between the outermost edges 3 and 4 and intermediate rounded corners 6 and 7, respectively. The rounded wing portions 8 and 9 are further provide safety, comfort and stability when engaging the shield 10 against the eyelid or corners of the eye. The arc is designed to engage against the eyelid, under the lashes following the natural curvature of the eyelid as shown in FIGS. 8–11. Referring further to FIG. 7, the edge of the arc 5, as viewed in cross section, includes a 45 degree offset to further facilitate placement against the surface of the user's skin.

The eye portion 1 is constructed as a relatively thin plastic eye portion extending from the curved arc 5 inwardly a distance of approximately 10 mm from a bottom center point of the curved arc 5 to an inwardly spaced, likewise arcuately curved, and generally parallel boundary 5' (see again FIG. 1) which defines a thicker portion of the handle 2. The purpose of the outer most and thinner section of the eye portion 1, relative to the boundary 5' proceeding into the handle 2, is to provide for enhanced fit and placement of the shield 10 against the upper/lower eye portions of the eye. The entire eye portion 1 is concave, as is best shown in FIGS. 3–6, and is further angled in cross section forwardly and away from the flat surface defining the handle of the tool approximately 140 degrees relative to a longitudinal line extending through the shield handle (see FIG. 6). The combination of the features of the configuration of the curved arc 5 and the concavity in cross section of the eyelet portion 1 provides for the ability of the eye portion 1 to "hug" the perimeter of the eyeball in a fashion not provided for by the prior art mascara shield devices.

Referring again to FIGS. 5 and 6, the handle 2 includes a top end and a bottom end and is contoured by providing a pair of divots 11 and 12 within its front facing surface and which are capable of being engaged by fingers (see again FIGS. 8–11) of the user. A concave section 13 is provided in the opposite rear facing surface of the handle 2, at a rear longitudinal location above that of the pair of front face divots 11 and 12 and prior to the boundary 5' with the eye portion 1, the rear concave section being particularly suited for placement against the cheekbone of the user when it is desirable to engage the eye portion 1 against the bottom eyelid (see again FIGS. 9 and 10) or, alternatively, against the brow ridge when placing against the top eyelid (see FIGS. 8 and 11). Upon viewing the handle portion 2 in cross section, the combination of the divots 11 and 12 in the forward face and the concave section 13 in the rearward face form a generally undulating shape along the longitudinal length of the handle 2. The shield 10 terminates at a width of approximately 17 mm at bottom most end 14 of the handle 2 prior to rounding out. Referring again to FIGS. 8, 9, 10 and 11, applicational views are shown at 15, 16, 17 and 18, respectively, of the makeup shield according to the present invention in use with both the upper and lower eyelids as previously explained.

It is apparent therefore that the ergonomic makeup shield of the present invention is an improvement over prior art makeup devices in that its unique construction provides for greater ergonomic contouring placement against the upper and lower eyelids of a user.

Having described my invention, additional embodiments will become apparent to those skilled in the art to which it pertains without deviating from the scope of the appended claims.

We claim:

1. An ergonomic makeup shield for establishing a barrier over the upper and lower eyelid areas of a user's face to prevent smearing during the application of mascara, said shield being constructed of a unitary body of a durable and impact-resistant material and comprising:

a generally elongate handle portion defined by a top end, a bottom end, a front face and a rear face separated from said front face according to a first selected thickness, said front face including a first inwardly contoured divot at a first selected longitudinal location from said bottom end and a second inwardly contoured divot at a second selected longitudinal location from said bottom end and which is spaced from said first longitudinal location of said first divot said rear face including a concave section at a further selected longitudinal location from said bottom end relative to said selected longitudinal locations of said first and second inwardly contoured divots, said first and second divots and said concave section forming in combination a generally undulating configuration of said handle when viewed in cross section; and a concave shaped eye portion integrally secured to said top end of said handle portion along a common boundary, said eye portion being according to a second selected thickness lesser than said thickness of said handle portion, said concave shaped eye portion terminating in an arcuately shaped edge portion capable of being placed contiguous with the upper and lower eyelids of the user.

2. The ergonomic makeup shield according to claim 1, said arcuately shaped edge portion further including a first intermediate rounded corner and a second intermediate rounded corner at opposite locations along said arcuate edge, said intermediate rounded corners being spaced inwardly from outermost edges of said arcuate edge and establishing rounded wing portions therebetween.

3. The ergonomic makeup shield according to claim 2, said arcuately shaped edge portion further comprising a 45 degree angled edge when viewed in cross section.

4. The ergonomic makeup shield according to claim 1, said concave shaped eye portion extending at a 140 degree angle relative to a longitudinal line extending through said handle portion when viewed in cross section.

5. The ergonomic makeup shield according to claim 1, said bottom end of said handle portion including a rounded edge.

* * * * *